US011105296B1

(12) United States Patent
Fountain

(10) Patent No.: US 11,105,296 B1
(45) Date of Patent: Aug. 31, 2021

(54) HOT AIR ENGINE SYSTEM

(71) Applicant: Daniel L. Fountain, Tucson, AZ (US)

(72) Inventor: Daniel L. Fountain, Tucson, AZ (US)

( * ) Notice: Subject to any disclaimer, the term of this patent is extended or adjusted under 35 U.S.C. 154(b) by 0 days.

(21) Appl. No.: 17/132,953

(22) Filed: Dec. 23, 2020

(51) Int. Cl.
*F02G 1/043* (2006.01)
*F02G 1/057* (2006.01)

(52) U.S. Cl.
CPC ..... *F02G 1/0435* (2013.01); *F02G 1/057* (2013.01); *F02G 2243/02* (2013.01); *F02G 2243/06* (2013.01); *F02G 2270/42* (2013.01)

(58) Field of Classification Search
CPC ..... F02G 1/04; F02G 1/043; F02G 1/0435; F02G 1/057; F02G 2243/04; F02G 2243/06; F02G 2243/30; F02G 2243/32; F02G 2243/02; F02G 2270/42
USPC ..... 60/519, 512, 515, 520, 524
See application file for complete search history.

(56) References Cited

U.S. PATENT DOCUMENTS 4,429,530 A * 2/1984 Beale ..... F02G 1/0435 60/520
4,676,066 A * 6/1987 Tailer ..... F02G 1/04 60/517
9,291,122 B1 3/2016 Fountain
2008/0295684 A1 12/2008 Lin
2017/0045018 A1* 2/2017 Kurita ..... F02G 1/053

FOREIGN PATENT DOCUMENTS

JP 59070860 A * 4/1984 ..... F02G 1/043
JP 08284751 A * 10/1996 ..... F02G 1/043

* cited by examiner

*Primary Examiner* — Mark A Laurenzi
*Assistant Examiner* — Mickey H France

(57) ABSTRACT

The present invention features a hot air engine system designed to improve the overall efficiency of the engine. The engine features a mechanism for oscillating a piston cylinder such that the pivot point is at the bottom of the cylinder. This mechanism improves the overall efficiency of the engine by reducing the side forces that are produced when the back and forth motion of a piston is converted into rotational movement. To achieve this mechanism, a set of arms is attached to the piston cylinder and extend into the displacer chamber and are attached to the displacer. When the displacer oscillates during operation of the engine, the arms swing, and the cylinder rod swings in line with the arms, causing the cylinder rod to pivot at the bottom of the cylinder. This engine system runs on almost boiling water and can use industrial wastewater as a fuel source.

18 Claims, 8 Drawing Sheets

FIG. 1

HOT AIR ENGINE SYSTEM

BACKGROUND OF THE INVENTION

The present invention relates to a hot air engine system, more specifically an alternative fuel engine system that runs on less than boiling temperature water. This invention can be used to recover hot industrial wastewater that is often wasted or simply poured down the drain.

The engine system described herein uses a mechanism for oscillating a piston cylinder such that the pivot point is at the bottom of the piston cylinder. This mechanism improves the overall efficiency of the engine by reducing the side forces that are typically produced when the back and forth motion of a piston is converted into rotational movement. To achieve this mechanism, a set of arms is attached to the piston cylinder via a cylinder rod and an arm connector. These rods extend into the displacer chamber and are fixedly attached to the displacer. When the displacer oscillates during operation of the engine, the arms swing, and the cylinder rod swings in line with the arms, causing the cylinder rod to pivot at the bottom of the cylinder.

BRIEF SUMMARY OF THE INVENTION

It is an objective of the present invention to provide systems and devices that allow for an efficient alternative fuel engine system as specified in the independent claims. Embodiments of the invention are given in the dependent claims. Embodiments of the present invention can be freely combined with each other if they are not mutually exclusive.

One of the unique and inventive technical features of the present invention is the mechanism of oscillating the piston cylinder. Without wishing to limit the invention to any theory or mechanism, it is believed that the technical feature of the present invention advantageously provides a mechanism for improving the overall efficiency of an engine.

In general, oscillating pistons reduce the side forces that are produced when the back and forth movement of a piston is converted into rotational movement. Side forces cause a binding like friction, thereby reducing overall efficiency of an engine. In order to oscillate a piston cylinder in the most ideal way, making it as friction free as possible, the pivot point should be at the bottom of the piston cylinder. Since the piston and the piston rod cause the oscillation when it rotates, if the rotation causes the bottom of the cylinder to ark or move sideways from the pivot point, more side forces will be present. This particular side force will be present if the pivot point is above or below the bottom of the cylinder, but will not be present if the pivot point is at the bottom of the cylinder. The present invention has the pivot point very near the bottom of the piston cylinder, which almost completely eliminates the side forces.

Other engine systems are built such that the pivot point of the piston cylinder is above or below the bottom of the piston cylinder. This causes the piston cylinder to ark or move sideways in relation to the pivot point, causing the geometric side force friction that reduces the overall efficiency of these engine systems. Furthermore, other engine systems may comprise tubing that allows an internal connection of the piston cylinder to the interior of the engine. The rubber tubing required for these systems may further reduce the overall efficiency of the engine system due to friction caused by the tubing bending back and forth during operation. In addition to the bending side forces caused by rubber tubing, the rubber will eventually wear out over time, and changing the tubing requires disassembly of the engine system. The present invention does not use rubber tubing to connect the piston cylinder to the interior of the engine.

Another inventive technical feature of the present invention is that the engine is scalable. The engine can be made larger if one were to expand or stretch it on the sides. This technical feature is possible because the displacer is square and hinged. If one were to expand or stretch a standard engine and still maintain the same RPMs as the smaller one, the ratio of air to metal surface area contact has to remain the same, so making a hot air engine bigger gets complicated quickly. With this engine design, if it were expanded on the sides, the square displacer would turn into a rectangle and the piston would need to be larger, but it would still have the same ratios of metal to air inside. The RPMs of a larger engine of this design should match a smaller one without any other changes or complications.

Furthermore, the hot air engine system is coupled to a magnetic induction generator. The magnetic induction generator is attached to the frame of the hot air engine system via a removable frame and comprises a plastic tube wrapped with a coil of wire and a cylindrically shaped magnet that moves horizontally from side to side within the plastic tube. The generator is operatively coupled to the engine system via a unique generator connecting rod. The generator connecting rod comprises: i) a ball bearing or crank pin on one end to connect the rod to the flywheel of the engine system and ii) a steel loop on the other end to attach to the flat side of the magnet. The steel loop operates like a ball and socket crosshead, however it is easier and less expensive to make. The steel loop simply sticks to the magnet and is rounded all around so it will pitch up or down and can pitch from side to side in a friction-free manner. A normal hinge type crosshead will bind when experiencing both motions at the same time. Thus, the steep loop acts like a ball and socket joint, but unlike a fixed crosshead, it will move on the magnet to adjust itself to the best possible angle with the flywheel. There is also no back and forth gap at the point where the loop sticks to the magnet. A back and forth gap in a hinge mechanism will make noise such as a clicking sound, but with this arrangement the operation is silent.

The magnetic induction generator only operates horizontally. The generator further comprises unique spring loaded adjustments bolts at the bottom of the plastic tube. These adjustment bolts allow the generator to be accurately leveled horizontally. The engine does not have the power to lift the magnet up, and to achieve maximum RPM's and to generate the most power, the generator must be leveled horizontally.

When the engine is operating and the flywheel is rotating, the crank pin on the flywheel causes the connecting rod to move, which in turn causes the magnet to move linearly within the tube. In order to generate an induction current in the coil of wire, the magnet must clear the coil on both sides. Wire leads on each side of the coil of wire provide usable output current.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

DETAILED DESCRIPTION OF THE INVENTION

Figure 1:
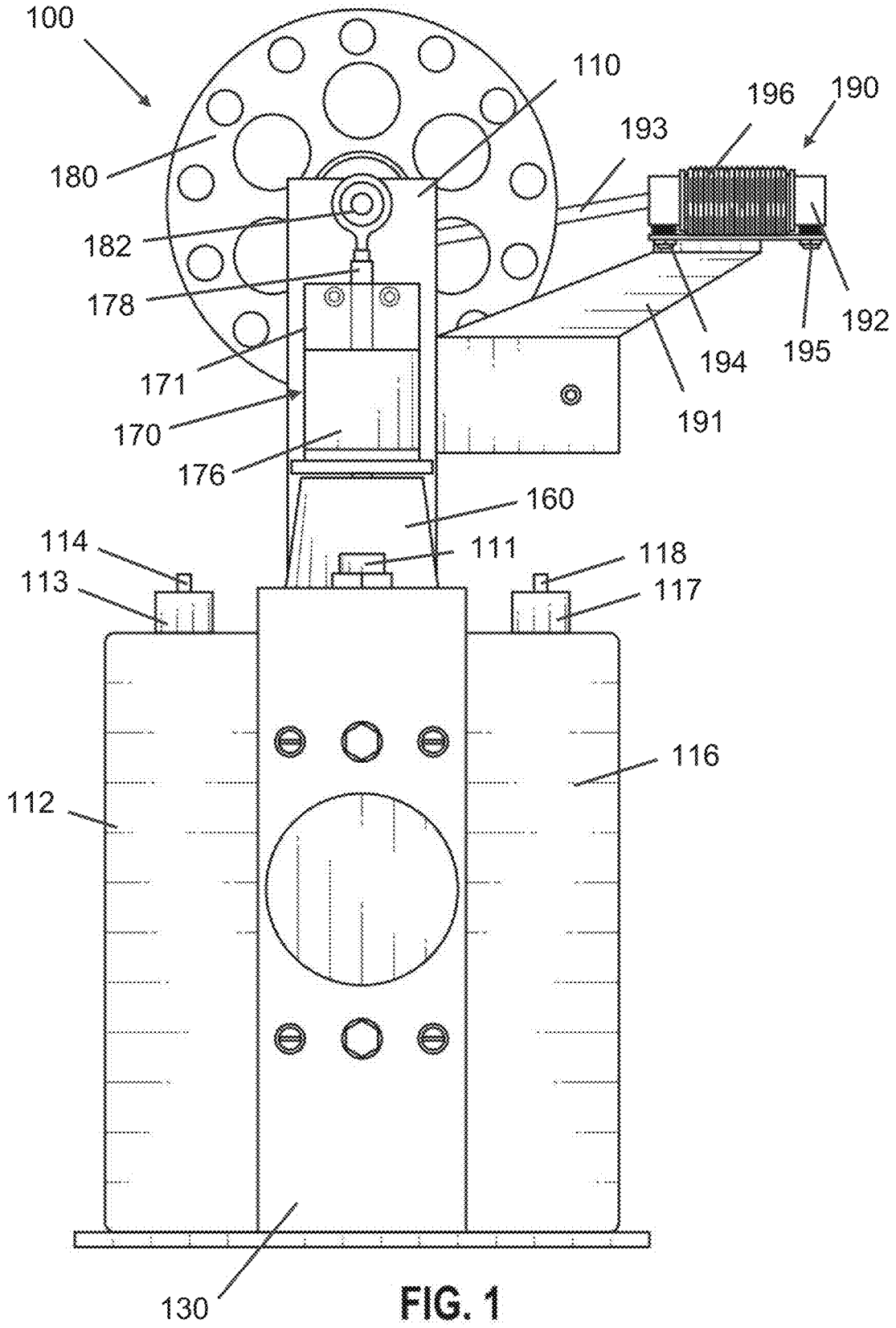
FIG. 1 shows a front view of the hot air engine system of the present invention.
Figure 2C:
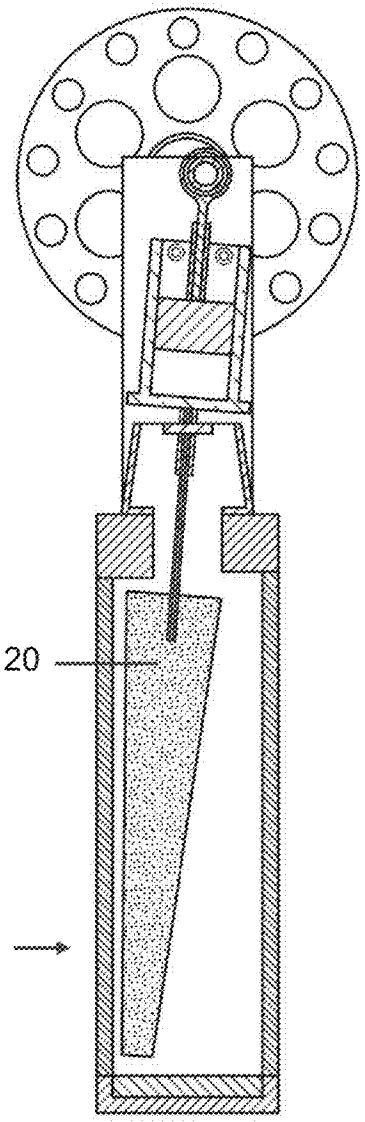
FIGS. 2A-2C show front cross-sectional views of the present invention during operation of the engine to show the movement of the cylinder assembly and the piston assembly with the movement of the displacer.
Figure 2B:
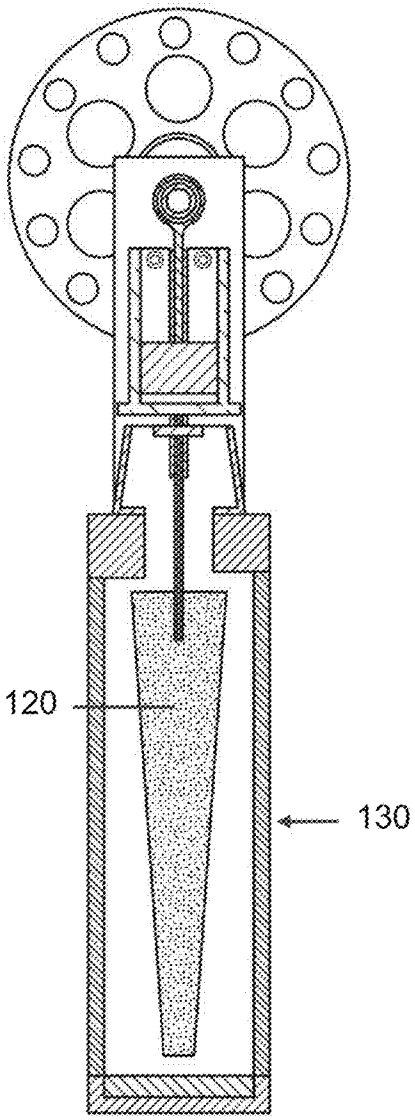
Figure 2A:
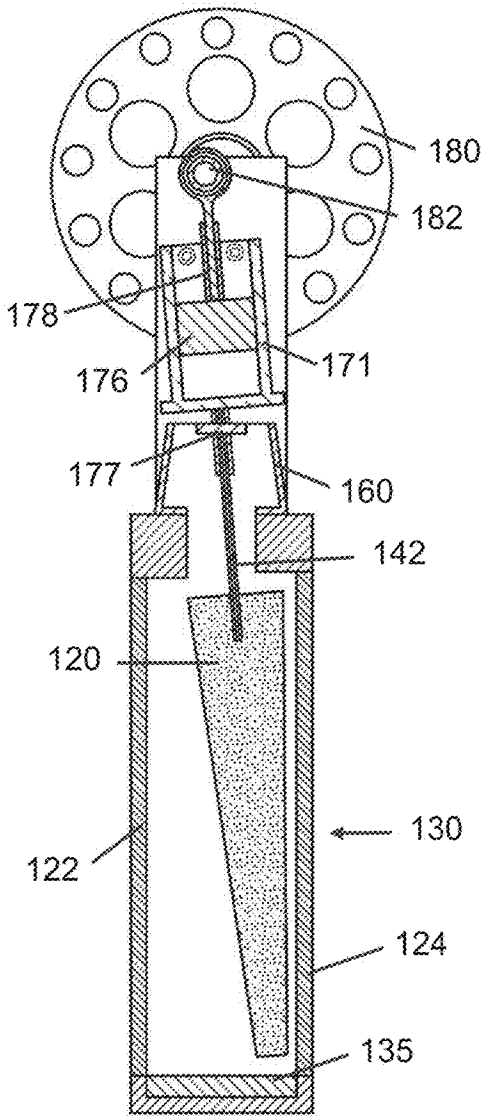
Figure 3A:
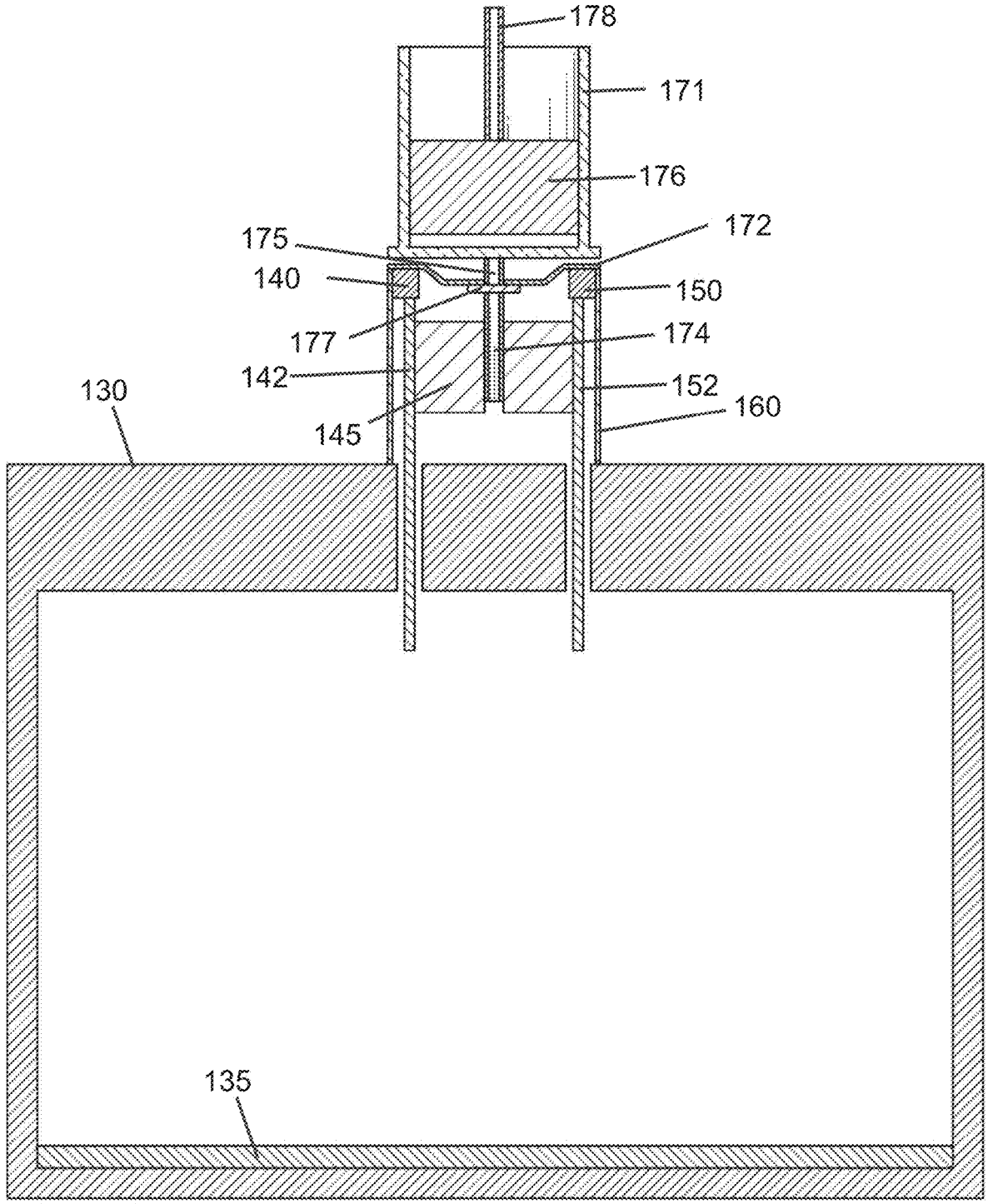
FIG. 3A shows a side cross-sectional view to show the connections between the displacer housing, the trapezoidal frame, the piston assembly, and the cylinder assembly.
Figure 3B:
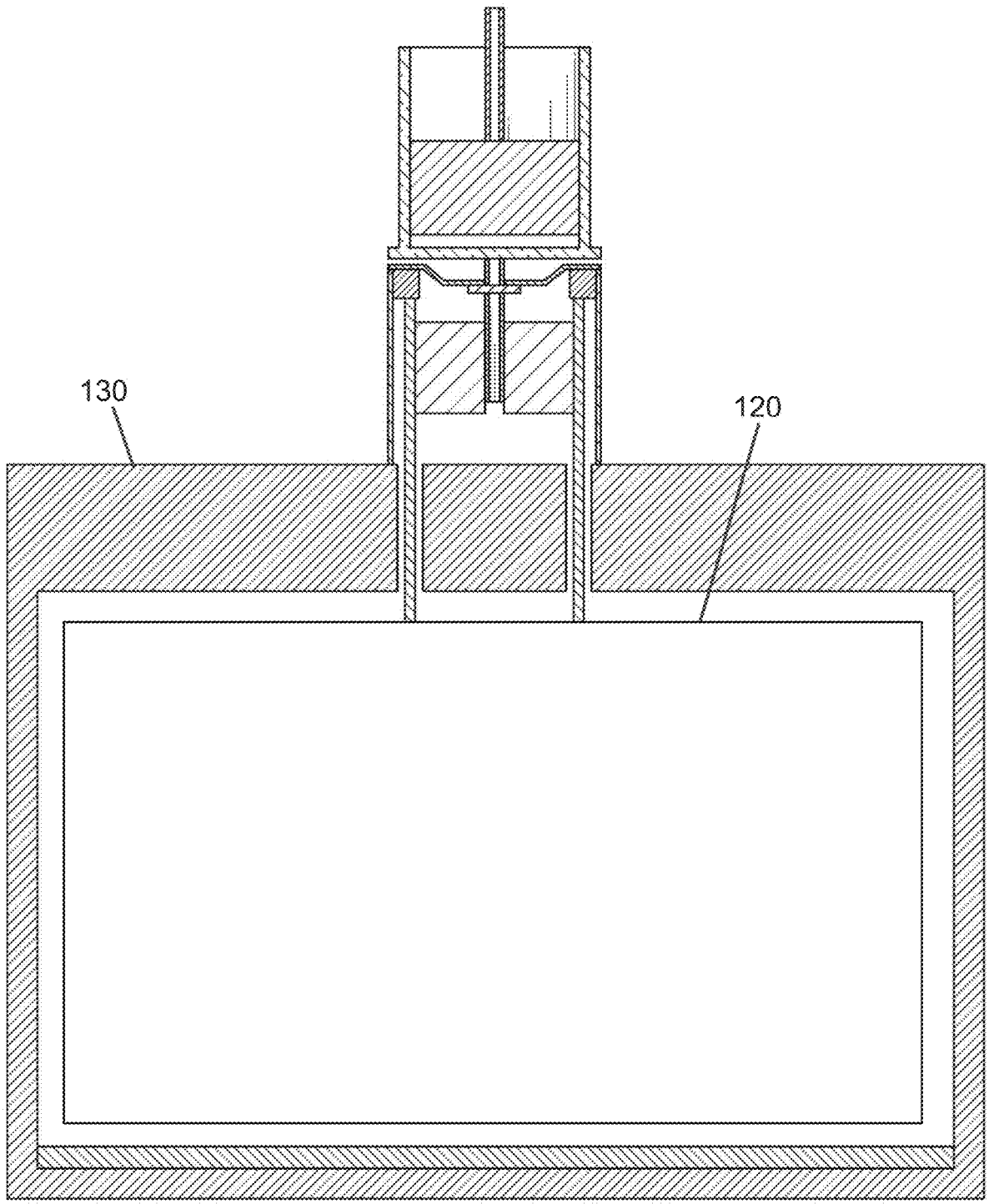
FIG. 3B is another side cross-sectional view showing the displacer connected to arms in the displacer housing.
Figure 4:
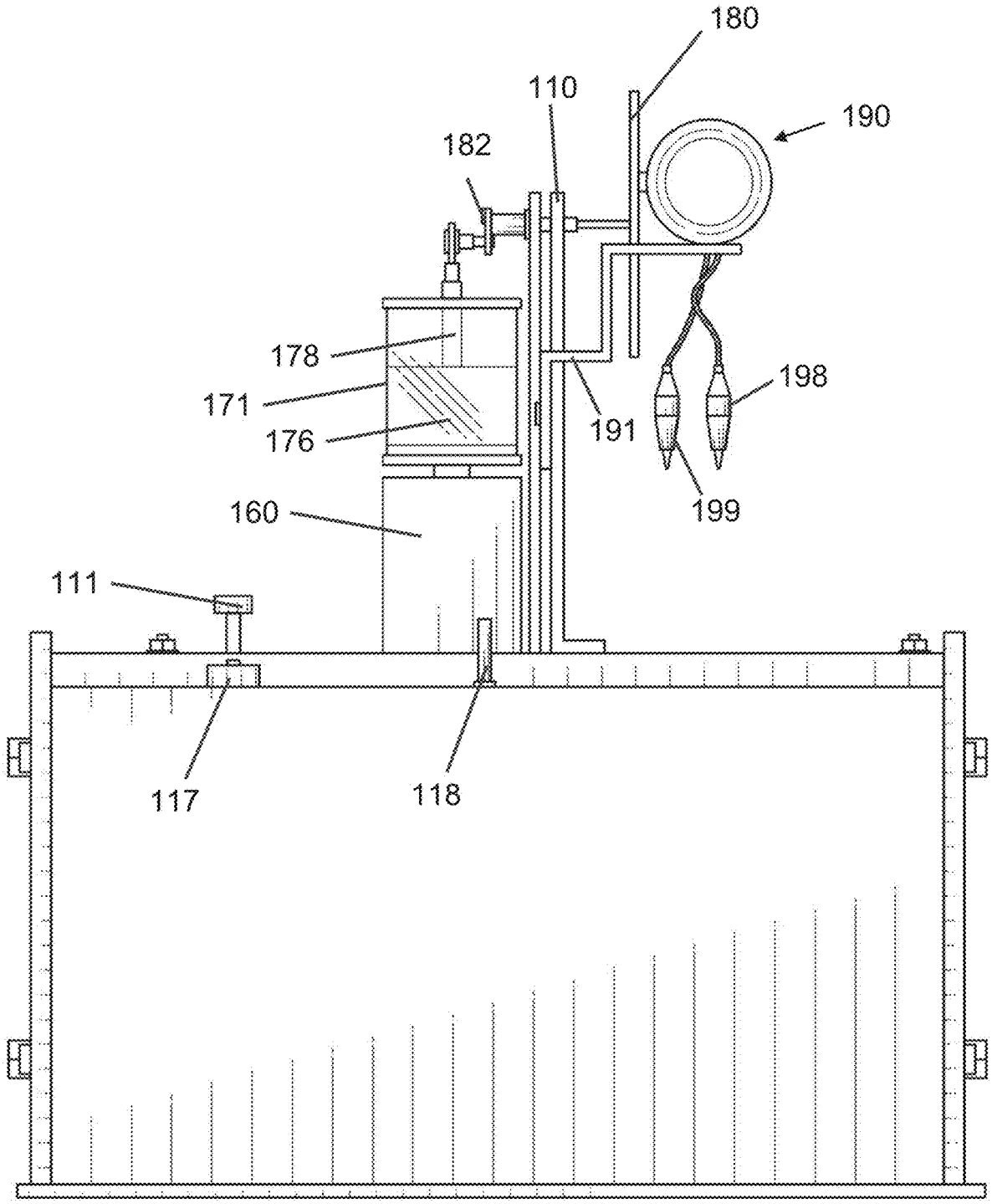
FIG. 4 shows a side view of the hot air engine system of the present invention.
Figure 5:
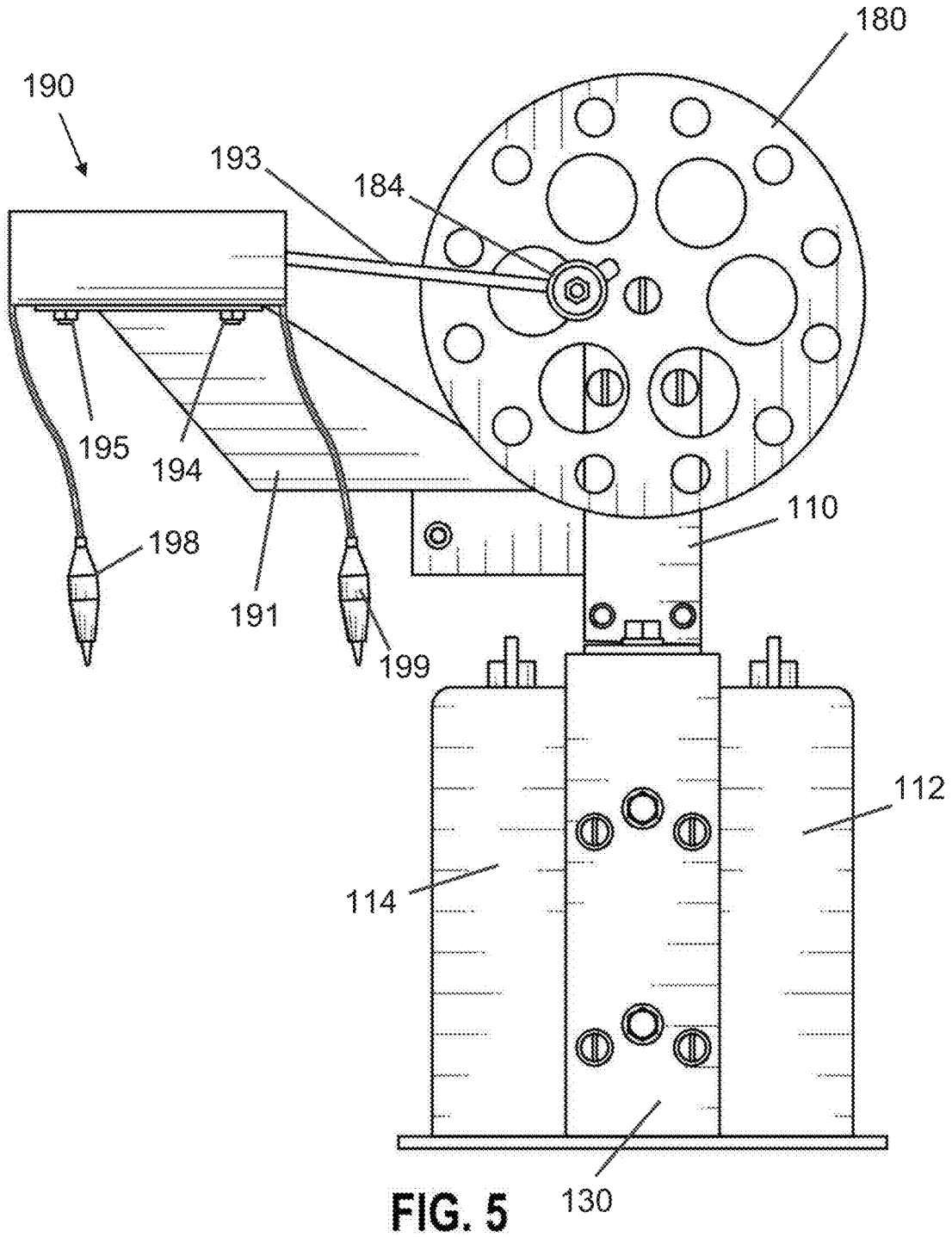
FIG. 5 shows a back view of the hot air engine system of the present invention.
Figure 6:
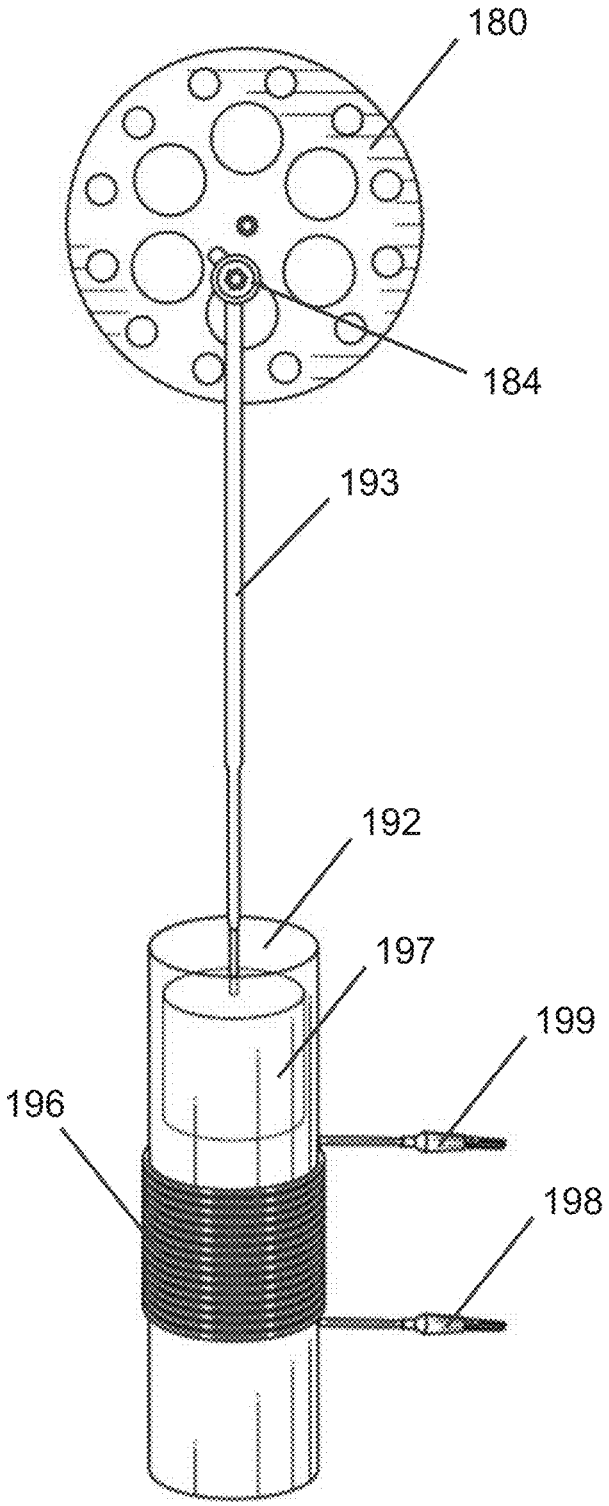
FIG. 6 shows a view of the magnetic induction generator and how the connecting rod connects the generator to the flywheel of the hot air engine system.
Figure 7:
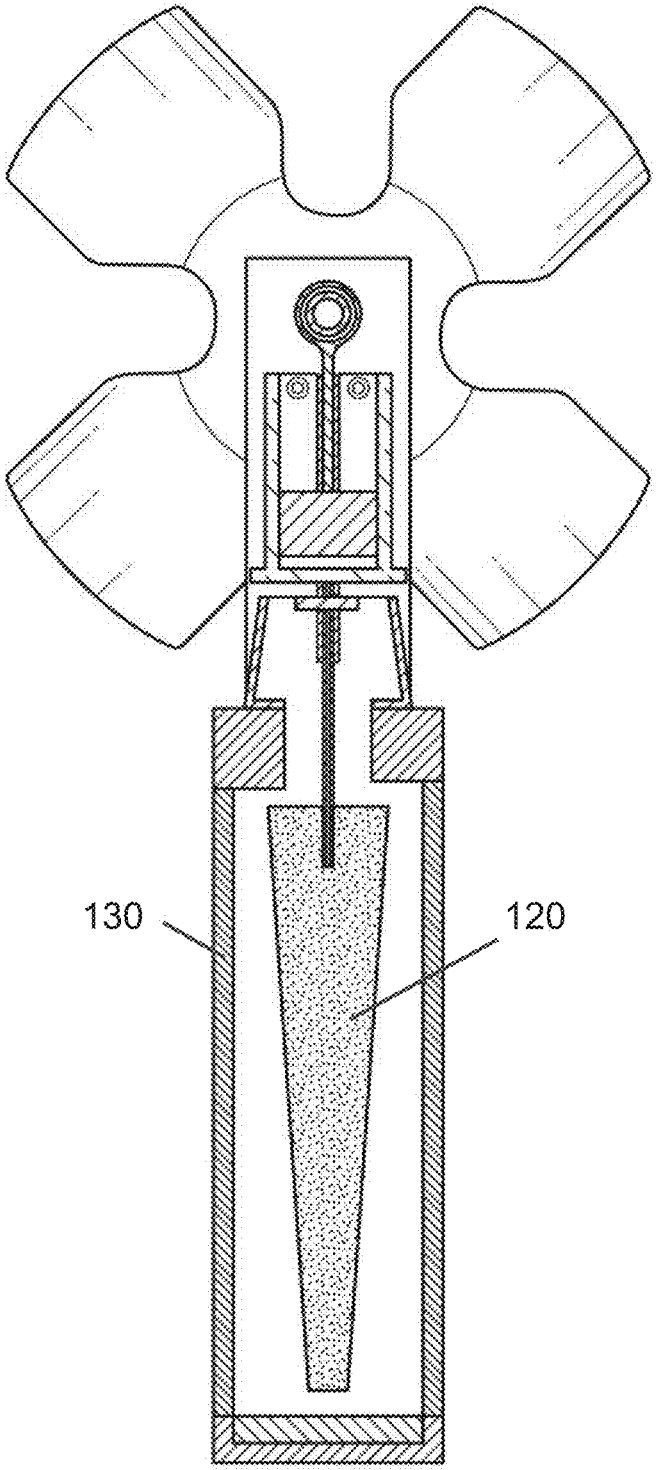
FIG. 7 shows an alternate embodiment of the hot air engine system, where the flywheel is replaced by a fan.

Following is a list of elements corresponding to a particular element referred to herein:

100 engine system
110 frame
111 plug
112 first reservoir
113 first reservoir fill cap
114 first reservoir vent
116 second reservoir
117 second reservoir fill cap
118 second reservoir vent
120 displacer
122 first metal plate
124 second metal plate
130 displacer housing
135 stationary regenerator
140 first hinge
142 first arm
145 arm connector
150 second hinge
152 second rod
160 trapezoidal frame
170 oscillating cylinder assembly
171 piston cylinder
172 brace
174 cylinder rod
175 pivot point
176 piston
177 pivot point diaphragm sealing gasket
178 piston rod
180 flywheel
182 first crank pin
184 second crank pin
190 magnetic induction generator
191 generator frame
192 plastic tube
193 connecting rod
194 first spring-loaded adjustment bolt
195 second spring-loaded adjustment bolt
196 coil of wire
197 magnet
198 first lead
199 second lead Referring now to FIGS. 1-7, the present invention features a hot air engine system (100) comprising a frame (110), a displacer chamber (130), a displacer (120), a trapezoidal frame (160), cylinder assembly (170), a piston assembly, and a flywheel (180). The displacer (120) is disposed inside the displacer chamber (130), and the displacer chamber (130) is coupled to the frame (110). A first reservoir (112) and a second reservoir (116) are coupled to the displacer chamber, and the first and second reservoir each comprise a fill cap and a vent. The trapezoidal frame (160) is disposed on top of the displacer chamber (130), and a first hinge (140) and a second hinge (150) are attached to the trapezoidal frame (160), and the first hinge and the second hinge are disposed on opposing sides of the trapezoidal frame. A first arm (142) is pivotally attached to the first hinge and a second arm (152) is pivotally attached to the second hinge, and the first arm and the second arm extend down into the displacer chamber (130) and are fixedly attached to the displacer (120). The first arm and the second arm are attached via an arm connector (145).

In preferred embodiments, the cylinder assembly (170) comprises a piston cylinder (171), a cylinder rod (174), and a brace (172). The cylinder rod (174) is pivotally attached to a bottom of the piston cylinder (171), forming a pivot point (175), and the brace (172) perpendicularly intersects the cylinder rod (174) near the pivot point. The brace has flared ends, and the cylinder rod extends into the trapezoidal frame (160) and is connected to the arm connector, and the flared ends of the brace rest upon the first hinge (140) and the second hinge (150). The cylinder rod (174) forms an airtight connection with the trapezoidal frame (160) via a diaphragm sealing gasket (177). In some embodiments, the diaphragm sealing gasket (177) is made from fiberglass fabric and silicone gasket material. In further embodiments, the piston assembly comprises a piston (176) and a piston rod (178). The piston (176) is disposed within the piston assembly and is slidably coupled to the piston cylinder (171). The piston rod is fixedly attached to the piston and projects away from the piston cylinder. The piston rod (178) is operatively coupled to a first end of a first crank pin (182), and a second end of the first crank pin is operatively coupled to the flywheel. In one embodiment, the flywheel is replaced by a fan.

In preferred embodiments, for operation of the hot air engine system, hot water is added to the first reservoir (112) and cold water is added to the second reservoir (114). The hot water heats air inside the displacer chamber and the cold water cools said air. The heating and cooling of the air causes the displacer (120) to oscillate within the displacer chamber (130). Oscillation of the displacer causes the first arm (142) and the second arm (152) to swing about the first and the second hinge, and the swinging first arm and second arm cause the cylinder rod (174) to swing in line with the first arm and the second arm. The swinging cylinder rod causes the piston cylinder (171) to pivot, which causes the piston assembly to slide up and down about the piston cylinder, thereby rotating the first crank pin (182), and the rotation of the first crank pin rotates the flywheel (180).

In other embodiments, the engine system (100) further comprises a magnetic induction generator (190). In preferred embodiments, the magnetic induction generator (190) comprises a generator frame (191), a plastic tube (192), a connecting rod (193), and a magnet (197). The generator frame (191) is attached to the frame (110) of the engine system, and the plastic tube (192) is disposed on the generator frame (191). A coil of wire (196) is wrapped around a midsection of the plastic tube (192), and a first lead (198)

extends from a first end of the coil of wire and a second lead (199) extends from a second end of the coil of wire. The plastic tube (192) is levelled horizontally via a first spring-loaded adjustment bolt (194) and a second spring-loaded adjustment bolt (195) disposed at a bottom of the plastic tube.

In other embodiments, the magnetic induction generator (190) is attached to the flywheel via a connecting rod (193). The connecting rod (193) comprises a first end that is operatively coupled to the flywheel (180) via a second crankpin (184) and a second end that is attached to a metal loop. The magnet (197) is magnetically connected to the second end of the connecting rod (193) via the metal loop, and the magnet (197) is disposed in the plastic tube (192). In preferred embodiments, during operation of the engine system, the rotation of the flywheel (180) moves the connecting rod (193), which in turn moves the magnet (197) from a first end of the plastic tube to a second end of a plastic tube. The side to side movement of the magnet (197) generates an induction current in the coil of wire (196), and the first lead (198) and the second lead (199) provide usable output of the induction current.

In some embodiments, the generator frame (191) is removable. In other embodiments, the coil of wire (196) comprises coated magnet wire. In one embodiment the generator (190) further comprises a cover to protect the generator. In further embodiments, the metal loop is made of steel or any other type of magnetic metal material. In further embodiments, the generator operates in a horizontal position, and the engine system operates in a vertical, upright orientation.

In some embodiments, a stationary regenerator (135) is operatively coupled to the inside of the displacer housing (130) such that the stationary regenerator (135) is below the displacer (120) at the bottom of the displacer housing, and the stationary regenerator (135) regenerates the heated air disposed in the displacer chamber (130). In further embodiments, a first side of the displacer housing is comprised of a first metal plate (122) and an opposite side of the displacer housing is comprised of a second metal plate (124). As a non-limiting example, the first and the second metal plates are comprised of stainless steel. Without wishing to limit the present invention to any theory or mechanism, the first and second metal plates allow for heat transfer between the first and second reservoir to the displacer housing.

In other embodiments, the engine system operates when there is at least an 80-180° F. difference between the first reservoir (112) and the second reservoir (116). In preferred embodiments, the temperature of the hot water in the first reservoir (112) is between 170-212° F., and the temperature of the cold water in the second reservoir (116) is between 32-60° F.

In other embodiments, the displacer (120) comprises a porous surface. In some embodiments the displacer (120) comprises through channels or a network of channels. In preferred embodiments, the front and back of the displacer (120) are triangular, and the sides are rectangular. In some embodiments, the displacer (120) is a straight rectangle and the displacer chamber (130) is trapezoidal such that the displacer is parallel to the surface of the displacer chamber at the highest points of the displacer's swing (e.g., when the velocity is zero).

The present invention features a method for generating electricity using a hot air engine system, the method comprising: providing a hot air engine system (100), attaching a magnetic induction generator (190) to the engine system, and adding hot water to the first reservoir (112) and adding cold water to the second reservoir (116). In some embodiments, a second crank pin (184) is operatively coupled to the flywheel (180), and the second crank pin (184) is operatively coupled to the magnetic induction generator via a connecting rod (193). In further embodiments, the flywheel is replaced by a fan.

In preferred embodiments, to operate the system, hot water is added to the first reservoir (112) and cold water is added to the second reservoir (114). The hot water heats air inside the displacer chamber and the cold water cools said air. The heating and cooling of the air causes the displacer (120) to oscillate within the displacer chamber (130). Oscillation of the displacer causes the first arm (142) and the second arm (152) to swing about the first and the second hinge, and the swinging first arm and second arm cause the cylinder rod (174) to swing in line with the first arm and the second arm. The swinging cylinder rod causes the piston cylinder (171) to pivot, which causes the piston assembly to slide up and down about the piston cylinder, thereby rotating the first crank pin (182), and the rotation of the first crank pin rotates the flywheel (180). The rotation of the flywheel (180) moves the connecting rod (193), which in turn moves the magnet (197) from a first end of the plastic tube to a second end of a plastic tube. The side to side movement of the magnet (197) generates an induction current in the coil of wire (196), and the first lead (198) and the second lead (199) provide usable output of the induction current.

In some embodiments, the engine system generates electricity when the temperature of the hot water in the first reservoir is at least 170-212° F. and the temperature of the cold water in the second reservoir is 32-60° F. In other embodiments, the engine system operates when there is at least an 80-180° F. difference between the first reservoir and the second reservoir.

As used herein, the term "about" refers to plus or minus 10% of the referenced number. Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hot air engine system (100), wherein the system comprises:

a. a frame (110), b. a displacer chamber (130) coupled to the frame (110);

c. a displacer (120) disposed inside the displacer chamber (130);

d. a first reservoir (112) and a second reservoir (116) coupled to the displacer chamber (130), wherein the first reservoir and the second reservoir each comprise a fill cap and a vent;

e. a trapezoidal frame (160) disposed on top of the displacer chamber (130), wherein a first hinge (140) and a second hinge (150) are attached to the trapezoidal frame (160), wherein the first hinge (140) and the second hinge (150) are disposed on opposing sides of the frame (160), wherein a first arm (142) is pivotally attached to the first hinge (140) and a second arm (152) is pivotally attached to the second hinge (150), wherein the first arm (142) and the second arm (152) extend downward into the displacer chamber (130) and are fixedly attached to the displacer (120), wherein an arm connector (145) connects the first arm (142) to the second arm (152);

f. an oscillating cylinder assembly (170) comprising a piston cylinder (171), a cylinder rod (174) pivotally attached to a bottom of the piston cylinder (171), forming a pivot point (175), and a brace perpendicular intersecting the cylinder rod (174) near the pivot point (175), wherein the brace has flared ends, wherein the cylinder rod (174) extends into the trapezoidal frame (160) and is connected to the arm connector (145), wherein the cylinder rod (174) forms an airtight connection with the trapezoidal frame (160) via a diaphragm sealing gasket (177), wherein the flared ends of the brace rest upon the first hinge (140) and the second hinge (150);

g. a piston assembly comprising a piston (176) disposed within and slidably coupled to the piston cylinder (171), and a piston rod (178) fixedly attached to the piston (176) and projecting away from the piston cylinder (170); and h. a first crankpin (182) comprising a first end and a second end, wherein the first end of the first crankpin is operatively coupled to the piston rod (178), wherein the second end of the first crankpin is operatively coupled to a flywheel (180);

wherein when hot water is added to the first reservoir (112) and cold water is added to the second reservoir (116), the hot water heats air inside the displacer chamber and the cold water cools said air, wherein heating and cooling of the air causes the displacer (120) to oscillate within the displacer chamber (130), wherein oscillation of the displacer causes the first arm (142) and the second arm (152) to swing about the first hinge (140) and the second hinge (150), wherein swinging first arm and second arm cause the cylinder rod (174) to swing in line with the first arm and the second arm, wherein the swinging cylinder rod (174) causes the piston cylinder (171) to pivot, which causes the piston assembly to slide up and down about the piston cylinder (171), thereby rotating the first crankpin (182), wherein rotation of the first crankpin (182) rotates the flywheel (180).

2. The engine system (100) of claim 1, wherein the engine system further comprises a magnetic induction generator (190), wherein the generator comprises:

a. a generator frame (191), wherein the generator frame (191) is attached to the frame (110) of the engine system;

b. a plastic tube (192) disposed on the generator frame, wherein a coil of wire (196) is wrapped around a midsection of the plastic tube (192), wherein a first lead (198) extends from a first end of the coil of wire and a second lead (199) extends from a second end of the coil of wire, wherein the plastic tube (192) is leveled horizontally via a first spring-loaded adjustment bolt (194) and a second spring-loaded adjustment bolt (195) disposed at a bottom of the plastic tube;

c. a connecting rod (193) comprising a first end and a second end, wherein the first end of the connecting rod (193) is operatively coupled to the flywheel (180) via a second crankpin (184), wherein the second end of the connecting rod is attached to a metal loop; and d. a magnet (197), wherein the magnet is magnetically connected to the second end of the connecting rod via the metal loop, wherein the magnet (197) is disposed in the plastic tube (192);

wherein during operation of the engine system, the rotation of the flywheel (180) moves the connecting rod (193), wherein the connecting rod (193) moves the magnet (197) from a first end of the plastic tube to a second end of the plastic tube, wherein the movement of the magnet (197) generates an induction current in the coil of wire (196), wherein the first lead (198) and the second lead (199) provide usable output of the induction current.

3. The engine system (100) of claim 2, wherein the generator frame (191) is removable.

4. The engine system (100) of claim 2, wherein the generator (190) further comprises a cover to protect the generator.

5. The engine system (100) of claim 2, wherein the metal loop comprises steel or any other magnetic metal material.

6. The engine system of claim 2, wherein the generator (190) operates in a horizontal position.

7. The engine system of claim 1, wherein the engine system (100) operates in a vertical, upright orientation.

8. The engine system of claim 1, wherein a stationary regenerator (135) is operatively coupled to the inside of the displacer housing (130) such that the stationary regenerator (135) is below the displacer (120) at the bottom of the displacer housing (130).

9. The engine system of claim 5, wherein the stationary regenerator (135) regenerates the heated air disposed in the displacer.

10. The engine system of claim 1, wherein the engine system (100) operates when there is at least an 80-180° F. difference between the first reservoir (112) and the second reservoir (116).

11. The engine system of claim 1, wherein the temperature of the hot water is between 170-212° F.

12. The engine system of claim 1, wherein the temperature of the cold water is between 32-60° F.

13. The system of claim 1, wherein the displacer (120) comprises a porous surface.

14. The system of claim 1, wherein the front and back of displacer are triangular, and the sides are rectangular.

15. A method for generating electricity using an engine system, the method comprising:

a. Providing the engine system of claim 1;

b. Attaching a magnetic induction generator (190) to the engine system, wherein a second crank pin (184) is operatively coupled to the flywheel (180), wherein the second crank pin (184) is operatively coupled to the magnetic induction generator (190); and c. Adding hot water to the first reservoir (112) and adding cold water to the second reservoir (116);

wherein the temperature difference between the first reservoir (112) and second reservoir (116) heats and cools the air inside the displacer chamber (130), wherein heating and cooling of the air causes the displacer (120) to oscillate within the displacer chamber (130), wherein oscillation of the displacer (120) causes the first arm (142) and the second arm (152) to swing about the first hinge (140) and the second hinge (150), wherein swinging first arm (142) and second arm (152) cause the cylinder rod (174) to swing in line with the first arm (142) and the second arm (152), wherein the swinging cylinder rod (174) causes the piston cylinder (171) to pivot, which causes the piston assembly to slide up and down about the piston cylinder (171), thereby rotating the first crank pin (182), wherein rotation of the first crank pin (182) rotates the flywheel (180), wherein rotation of the flywheel (180) moves the second crank pin (184) which moves the connecting rod (193), wherein the connecting rod (193) moves the magnet (197) from a first end of the plastic tube to a second end of the plastic tube, wherein the movement of the magnet (197) generates an induction current in the coil of wire (196), wherein the first lead (198) and the second lead (199) provide usable output of the induction current.

16. The method of claim 15, wherein the engine system generates electricity when the temperature of the hot water in the first reservoir is at least 170-212° F.

17. The method of claim 15, wherein the engine system generates electricity when the temperature of the cold water in the second reservoir is at least 32-60° F.

18. The method of claim 15, wherein the engine system operates when there is at least an 80-180° F. difference between the first reservoir and the second reservoir.

* * * * *